US005852842A

United States Patent [19]

Stern

[11] Patent Number: 5,852,842

[45] Date of Patent: Dec. 29, 1998

[54] FLOOR TREATING DEVICE WITH SHEEPSKIN COVER

[75] Inventor: Jeffrey A. Stern, Bayside, Wis.

[73] Assignee: Stern Tanning Co., Inc., Sheboygan Falls, Wis.

[21] Appl. No.: 777,530

[22] Filed: Dec. 30, 1996

[51] Int. Cl.[6] ..... A47L 13/10; A47L 13/38

[52] U.S. Cl. ..... 15/228; 15/235; 15/247

[58] Field of Search ..... 15/228, 235, 247

[56] References Cited

U.S. PATENT DOCUMENTS

| | | | |
|---|---|---|---|
| 528,754 | 11/1894 | Ziegler | 15/235 |
| 2,858,559 | 11/1958 | Carlson, Sr. | 15/247 |
| 3,699,603 | 10/1972 | Popeil . | |
| 4,858,267 | 8/1989 | Unger | 15/228 |
| 5,042,105 | 8/1991 | Buck | 15/247 |
| 5,177,831 | 1/1993 | Wirth | 15/235 |
| 5,331,711 | 7/1994 | Kelly | 15/247 |

FOREIGN PATENT DOCUMENTS

| | | | |
|---|---|---|---|
| 341466 | 1/1931 | United Kingdom | 15/235 |

OTHER PUBLICATIONS

Advertisement of Jones Companies, Ltd. of Humboldt, TN for Jones Dust–Mop.

Advertisement of Woodbury Box Company, Inc. of Woodbury, GA for Clip–On value hardware.

*Primary Examiner*—Randall E. Chin

*Attorney, Agent, or Firm*—Andrus, Sceales, Starke & Sawall

[57] ABSTRACT

The floor treating device includes a tubular sheepskin sleeve telescoped over a single piece wooden head having a bottom side and a top side. A handle is threaded into an opening on the top side and passed through an opening in the sleeve. The sleeve is formed from sheepskin blanks of a length of the head length and is formed from a sheepskin blank having a width greater than the bottom side of the head. A single blank has opposed longitudinal edges which are sewn together to form the sleeve. A pair of scrap sheepskin blanks cover on the bottom of the head have the opposed longitudinal edges sewn together to form the sleeve. The sewn seam extends outwardly or inwardly into engagement with the head. One end of the sleeve edges may have the end sewn together to again form a closed end. The sleeve is formed of a tanned sheepskin with the nap exposed for engagement with the floor, and the skin engaging the head, and has a reasonably firm fit to the head. The handle opening and fit maintain stability and location of the sleeve on the head.

16 Claims, 2 Drawing Sheets

FIG. 1
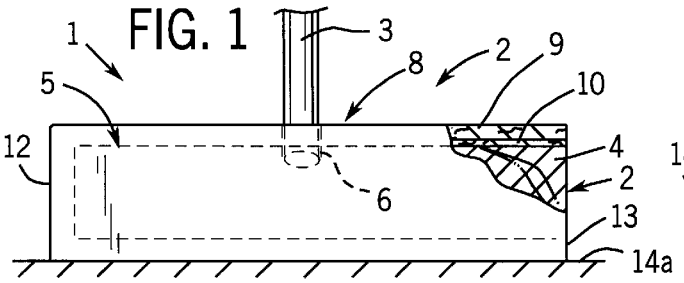
FIG. 3
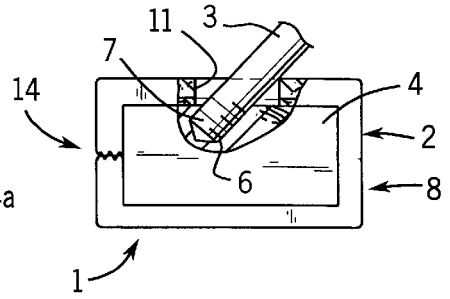
FIG. 2
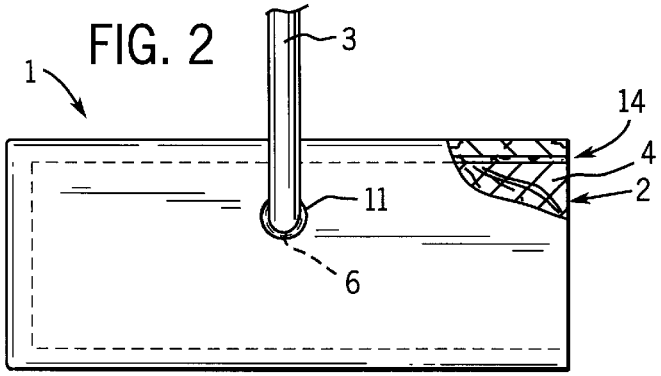
FIG. 4
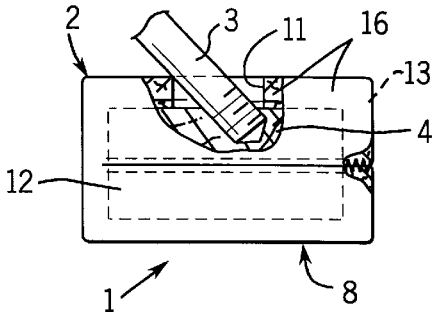
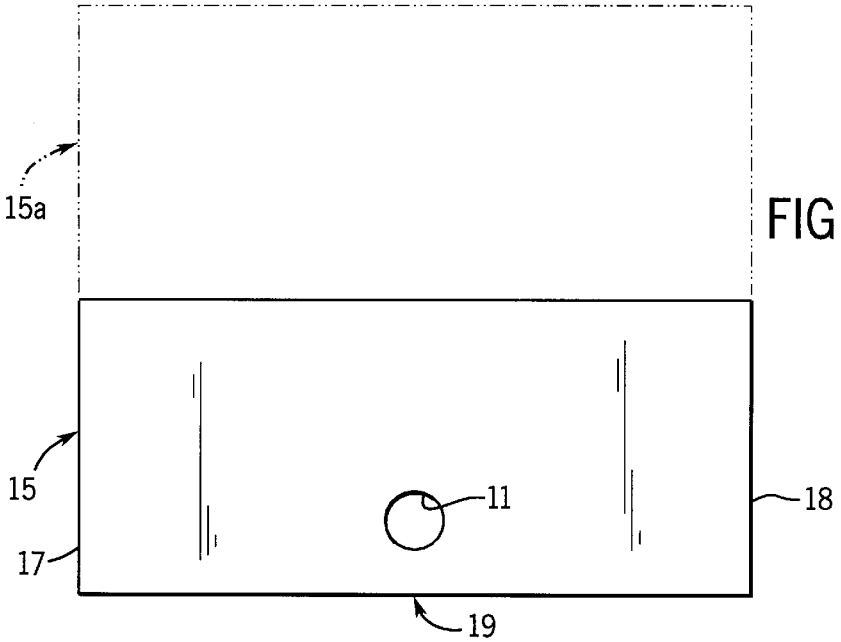
FIG. 5
FIG. 6
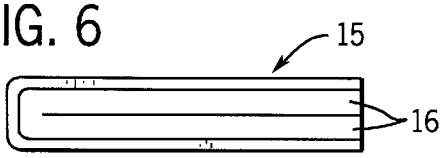
FIG. 7
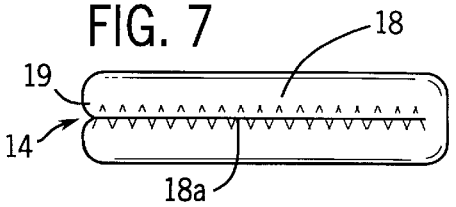

FLOOR TREATING DEVICE WITH SHEEPSKIN COVER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a floor treating device, and particularly for cleaning, polishing and/or waxing of a floor.

Floor cleaning and maintaining not only requires periodic washing, but often require waxing and polishing. Various hand operated devices are commercially available. Thus, rag and sponge mops are widely used for cleaning. Generally, a sponge pad is releasably secured to a pad holder and a means is provided for manual collapsing of the sponge pad for removing of the dirty water and the like. Generally, the pads are secured to a mounting base having threaded attachment with such as a clip mechanism or other separate holder on the outer end of the mop handle. Rotating devices such as disclosed in U.S. Pat. No. 3,699,603 are also suggested in the prior art. As shown in the above patent, a sponge covered roller is secured with the handle attached to the axial end of the sponge roller to provide a rolling action. An outer fabric cover or shell is provided over the sponge to protect the sponge structure.

For polishing a floor, various automated devices are used, including rotating pad devices. Manual devices are also available. The manual devices are generally constructed in accordance with the sponge mop devices.

A particular commercially available unit for manual treatment includes a sheepskin covered wood block unit having a handle releasably secured thereto. A tanned sheepskin blank or pad is folded about a wood block with the opposite ends interposed between the wood block and an outer clamp block. Clamping screws clamp the blocks to each other and releasably secure the pad in place. The structure including the tanned sheepskin blanks is relatively costly compared to cloth pads. The product can use relatively inexpensive scrap sheepskin material to reduce the cost. Generally, the quality characteristic has provided the necessary justification for the cost of the sheepskin floor treating devices. The method of assembly and replacement of the sheepskin cover is also inconvenient in wrapping of the opposite end portion about the head block and attachment of the clamp block for holding of the sheepskin pad place.

Because of the advantages and demand for the sheepskin covered floor treating device, there is a need for a more convenient system of assembly and replacement while maintaining the quality characteristics of the existing devices, and preferably at a similar or reduced cost.

BRIEF SUMMARY OF THE INVENTION

The present invention is particularly directed to a cost effective replacement unit for a floor treating device with a sheepskin covered head unit. Generally, in accordance with the teaching of the present invention, a head unit includes a tubular sheepskin sleeve telescoped over a single head member to which a handle is secured. The head member has a top side and a bottom side and includes a handle attachment or coupling unit and a releasably interconnected handle. The tubular sheepskin sleeve includes an opening aligned with the handle attachment unit and the handle which contributes to holding the sheepskin sleeve in place upon the head.

In a preferred construction of the present invention, tanned sheepskin blanks are formed, preferably from scrap sheepskin. The head unit is a block-like member and preferably a simple rectangular block of wood. A handle coupling is secured to the top side of the block. At least one blank has a width greater than the width of the head. The blanks are secured to each other along the opposite edges to form the sleeve with an end opening. A handle opening is formed in the one blank and the tubular sleeve is assembled to the head with the seams spaced from the bottom finishing surface and the handle opening on the top side. In a preferred fabrication, the blanks are assembled with sheepskin nap in face-to-face relation and interconnected as by sewing along the longitudinal edges. The sewn tube is turned inside out to expose the nap, with the interconnecting seams on the inner face and with the desired tubular configuration for telescoping over the head, with seams facing inwardly along the opposite sides of the head.

In the preferred construction of this embodiment, one end would also be sewn together during the initial sewing of the single or two sheepskin blanks such that the sleeve is closed at one end.

The sleeve can, of course, be formed of a single sheepskin blank having a width sufficient to completely encircle and form a tubular sleeve, with a single longitudinal connecting edge. A preferred construction would again include closing one end of the sleeve. In fabrication, the blank would be folded on the inner nap and exposing the sheepskin base skin. The edges of the blank are sewn or otherwise secured along the longitudinal edges and one end edge, and then inverted to expose the nap to form the sleeve with the one end opening for sliding onto the wood block.

The handle coupling may be of various constructions. For example, a simple handle coupling may include a threaded opening in the top wall of the wooden block. The handle has a threaded end which passes through the opening in the sleeve and into the threaded opening. Other forms such as a swivel coupling including a rod member secured to the top wall and projecting upwardly for receiving of a clip-on secured to the end of a handle. In this instance, the sleeve will be formed with an appropriate slit or opening to expose the coupling rod, again secured to the top side of the wooden block.

The sleeve construction eliminates the multiple part head and provides a cost effective floor treating device, with ease of assembly and cover replacement. This provides a truly cost effective unit because of the very minimal material costs in not only the use of a single block support, but the use of the least expensive sheepskin in forming of a sleeve.

BRIEF DESCRIPTION OF THE SEVERAL VIEWS OF THE DRAWINGS

The drawings illustrate the best mode presently contemplated of carrying out the invention.

In the drawings:

FIG. 1 is a front elevational view of a floor treating device of one embodiment of the present invention;

FIG. 2 is a top view of the embodiment shown in FIG. 1;

FIG. 3 is an end elevational view of the embodiment shown in FIG. 1, and viewed from the right side of FIG. 1;

FIG. 4 is an end view to the left side of FIG. 1;

FIG. 5 is a view illustrating the construction of a sleeve shown in FIGS. 1–4;

FIG. 6 is an end view of the right end of the sleeve as shown in FIG. 5;

FIG. 7 is an end view of the left end of the sleeve as shown in FIG. 5;

DETAILED DESCRIPTION OF THE ILLUSTRATED EMBODIMENT

Figure 8:
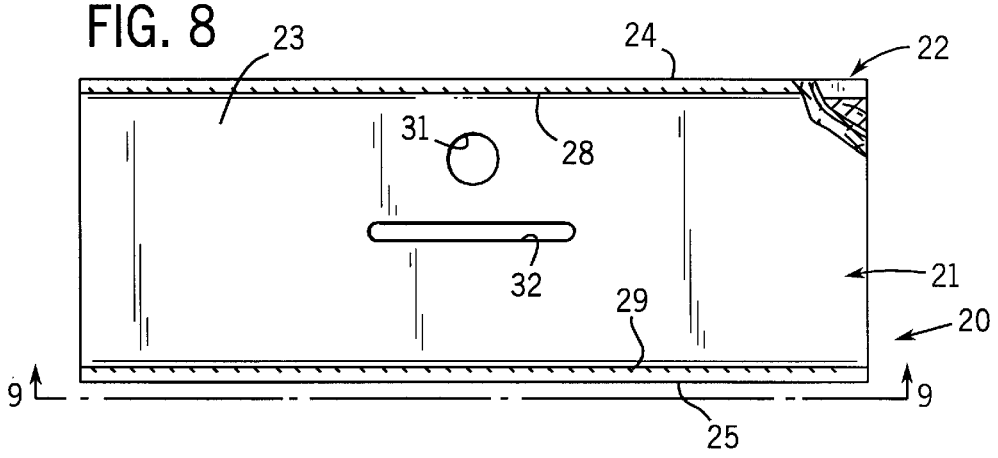
FIG. 8 is a view similar to FIG. 5 illustrating an alternative construction of a sleeve.

Referring to the drawings and particularly to FIGS. 1–4 inclusive, one preferred embodiment of a floor treating device constructed in accordance with the teaching of the present invention is illustrated.

Referring particularly to FIGS. 1 and 2, the floor treating device 1 as illustrated includes a substantially rectangular head unit 2. A handle 3 extends outwardly from the head unit 2 at an angle for convenient manual manipulation of the floor treating device. The head unit 2 includes an inner single piece head shown as a block 4. The top wall 5 of the head block 4 includes an angled threaded opening 6. The handle 3 has a threaded end 7 which threads into the opening 6 to interconnect the two in accordance with conventional interconnection of known devices. In accordance with the teaching of the present invention, an outer sheepskin sleeve 8 is telescoped over the head block 4 with the nap 9 exposed for engaging and treating the exposed floor and the skin 10 abutting the block 4. The sleeve 8 includes an appropriate opening 11 through which the handle 3 projects into the threaded opening 6. The sleeve 8 fits snugly about the block 4 which with the handle coupling to the sleeve maintains the sleeve position during the treatment of the floor, such as cleaning or polishing thereof.

More particularly, the one preferred structure of the outer sleeve 8 is illustrated in FIGS. 1–4. The sheepskin sleeve is a tanned hide with the nap exposed and cut to an even outer surface. In particular, the sleeve 8 is shown formed from a single piece of sheepskin and having one closed end 12 and an opposite open end 13 for assembly to the head block 4. In addition, the one-piece sleeve 8 includes a longitudinal seam 14 extended inwardly across the back of the block 4 with the uninterrupted nap 9 of the sheepskin sleeve 8 engaging the floor 14*a*.

The sleeve of FIGS. 1–4 is thus readily formed from a single sheet or blank 15 of sheepskin, such as illustrated in FIGS. 5–7. Depending upon the size of the sleeve, the sheepskin blank 15 may be formed of any suitable material including scrap material. For larger sized treating devices, the sheepskin blanks may be formed from a larger tanned skin, rather than scrap sheepskin.

The sheepskin blank 15 is shown in FIG. 5 with half the blank shown in phantom at 15*a*. The blank 15 is folded onto the nap side 16 (FIG. 6) with the two sets of end edges 17 and 18 and the longitudinal edges 19 aligned, as shown in FIGS. 5 and 6. The aligned edges are then joined to each other along the longitudinal edges 19 and the one set of end edges 18 in any suitable manner. Conventional sewing of the edges of the blank 15 and including the nap 7 and the skin 10, just inwardly of the outermost end of the edges has been used in fabrication to form the longitudinal seam 14 and an end seam 18*a*. After sewing, the formed tubular unit of FIGS. 5 and 6 is turned inside out to expose the nap and form the tubular sleeve 8 of FIGS. 1–4, as shown in FIG. 7.

The opening 11 in the blank 15 is preferably formed prior to the folding and sewing of the blank edges 18 and 19. As illustrated in FIGS. 1–4, the opening 11 is formed near the longitudinal edges 19 of the folded blank 15 and thereby located adjacent the longitudinal seam 14 such that in the final assembly, the seam 14 is located on the back surface of the block 4 as shown in FIGS. 2 and 3 to ensure a smooth, continuous floor engaging undersurface of the sleeve.

The illustrated floor treating device with the sheepskin sleeve 8 provides a cost effective sheepskin floor treating device. Single piece head, and particularly the illustrated block 4 is simply formed of wood or other material to receive the handle 3, with the handle serving to locate and hold the sleeve 8 in position. The sleeve is also preferably formed with the relatively snug fit of the sleeve onto the block 4 to further contribute to the fixing of the sleeve in place. In addition, the inner longitudinal seam 14 engages the block 4 to further stabilize the sleeve location onto the block during the use.

The illustrated construction provides minimum number of parts, each of which is relatively inexpensive and contributes to a favorable fabrication cost factor. Further, the handle structure and sleeve opening not only provides a cost effective construction, but provides for a rapid and efficient assembly and disassembly of the sleeve.

Figure 9:
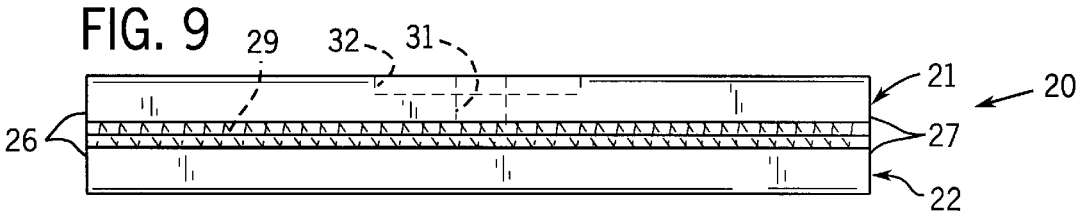
FIG. 9 is a view of FIG. 8, taken generally on line 9—9 of FIG. 8.
Figure 10:
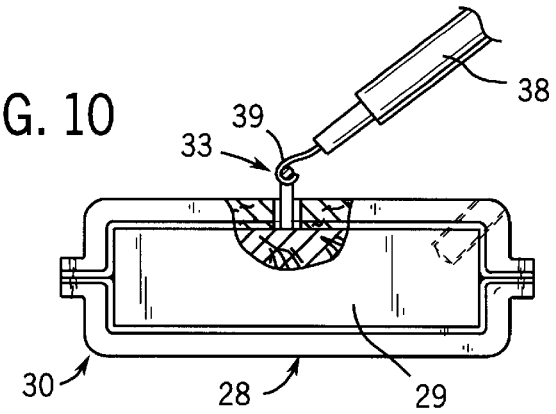
FIG. 10 is an end view of floor treating apparatus illustrating a further embodiment of the present invention.

The sleeve as previously discussed, can be formed of interconnected scrap material with many different sizes of the head structure. For example, FIGS. 8 and 9 disclose construction of a sleeve 20 from scrap sheepskin pieces or blanks 21 and 22. The pieces are assembled with the nap 23 of the pieces in exposed relation, the skin 23*a* between the blanks and the longitudinal edges 24 and 25 and side or end edges 26 and 27 in alignment. Both longitudinal edges 24 and 25 are sewn or otherwise securely interconnected to each other as at 28 and 29. One of the aligned end edges 26 or 27, may also be sewn or otherwise secured to each other and thereby forming a tubular sleeve 28 telescoped over a block 29*a*, as shown in FIG. 10, of a floor treating device 30.

The one skin blank, shown as 21, is formed with an appropriately located opening 31 and is also shown with an elongated slit 32 extending longitudinally of the device to ensure the location of the longitudinal seams 28 and 29*a* defined by the sewn edges 24 and 25 along the sides of the sleeve 20 such that on assembly to the block 29, the bottom surface is a smooth, complete, and uninterrupted nap surface. If scrap skins of different widths are used, the opening 31 and slit 32 are placed in one skin to insure spacing of the seams 28 and 29 from the bottom surface.

Figure 11:
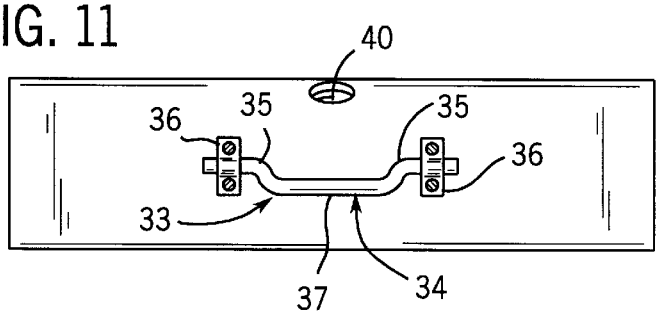
FIG. 11 is a top view of head shown in FIG. 10.
Figure 12:
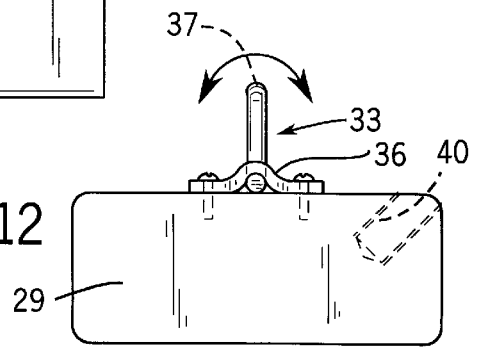
FIG. 12 is an end view of the head shown in FIG. 11.

As previously noted, the interconnection of the handle to the head or block-like member may be of any suitable construction. For example, shown in FIG. 10, a known swivel connector or coupler unit 33 is secured to the upper wall of the block 29. The coupler unit 33 is known a known mop connecting device and includes a U-shaped coupler member 34 with L-shaped legs 35, as shown in FIGS. 10–12. Clamping elements 36 such as simple metal straps are secured as by suitable screws to the block 29 overlying the offset legs 35 and allowing pivoting of the coupler member 34, as shown in FIGS. 11 and 12. The raised cross rod 37 provides for simple interconnection of a handle having a known clip unit 39 on the bottom attachment end.

The sleeve 28 for use with the swivel connector or coupler is provided with the slit 32 in the top side of the sleeve through which the rod 37 projects for interconnection to the handle 38. Thus, as in the first embodiment, the sleeve 28, which is slidably fitted over the block, is simultaneously further stabilized through the interconnection of the coupling to the sleeve.

As illustrated in FIGS. 10–12, a head 29, shown as a block of wood, can be readily formed for receiving either of the couplings 33 (FIGS. 11 and 12 illustrate the head without the sleeve for clearly showing the handle couplers). The threaded opening 40 is offset from the center of the wooden block and adjacent the trailing side of the device. The swivel rod unit 33*a* is secured generally to the center of the wooden block.

The head 29 would thus permit coupling of the sleeve 28 with either handle 38 or a handle 3.

Although shown with the head 29 and sleeve 28 shown with the dual coupling construction, individual related heads and sleeves for each of the coupling systems may, of course, be produced.

As previously noted, the coupling may be as illustrated or of any other suitable releasable handle connection to permit the convenient assembly and replacement of the tubular sleeve. The coupling preferably is constructed to provide a minimum number of different parts and preferably for attachment to the one piece block-like member which can be readily constructed to receive any of the desired handle constructions directly or through the simple location of the handle coupling to the block-like member.

The embodiments shown in the drawings are thus illustrative of the preferred constructions, which can, of course, be modified if desired in any suitable manner, while maintaining the efficiency and effectiveness of the assembly and cost effectiveness of the device. Clearly, both ends of the tubular sleeve can be opened. Further, where a single piece blank is used, the opening for the handle may be formed in the seam by providing an unsewn portion in the seam and in appropriate longitudinal alignment with the handle opening or other securement system. The significant factor is to maintain the simplicity of the assembly, including a single head adapted to releasably receive a handle and a sleeve encircling the block with appropriate interengagement by the handle and coupling through the handle to the head.

I claim:

1. A floor treating device, comprising an elongated rigid block head having a top wall and a bottom wall spaced from said top wall, a tubular sheepskin sleeve formed substantially of sheepskin having the original skin and an outer nap, said sleeve having an open end and fitted over said head with the skin abutting the top wall and the bottom wall of said rigid head and the nap exposed and with said sleeve including a bottom nap surface which is a complete and uninterrupted nap surface, a handle coupling on the top wall of said head, said sheepskin sleeve having a coupling opening extending through said skin and nap and substantially corresponding in size and shape to said handle coupling and aligned with said handle coupling, a handle releasably secured to said coupling and engaging said sleeve to provide stability to the location of the sleeve and to support the sleeve having said uninterrupted bottom nap surface abutting said bottom wall, said sheepskin sleeve being formed of at least one sheepskin blank having a longitudinal edge seam spaced from said opening and from the bottom nap surface and bottom wall and with said seam projecting inwardly into engagement with said head.

2. The device of claim 1, wherein said tubular sleeve is formed from two separate sheepskin blanks of sheepskin having aligned longitudinal edges and end edges, and including a securement element connecting said longitudinal edges including said skin to form said tubular sleeve.

3. The device of claim 2 wherein said securement element includes an interconnecting thread member passing through said skin.

4. The device of claim 2 wherein said head includes a wooden block having a threaded opening in the top side of the head, said handle has a threaded end threaded into said threaded opening with said skin engaging said handle to provide a support about the handle, the diameter of said coupling opening being substantially equal to the portion of said handle passing through said skin.

5. A floor treating device comprising a head in the form of an elongated rigid block member including said bottom wall and said top wall, a first handle coupling and a second handle coupling on the top wall of said block member, a tubular tanned sheepskin sleeve consisting of a skin and an outer integral nap and snugly fitted over said member with the skin abutting the top wall and bottom wall and having a coupling opening aligned with one of said handle couplings, said sleeve including at least one open end, the coupling opening being aligned with one of said handle couplings and substantially the same size and shape as one of said handle couplings, said sleeve being formed from a folded sheepskin blank having at least one aligned longitudinal edge with a connecting element securing the skin and nap inwardly of the edges to form a seam, and a handle releasably secured to said one of said handle couplings to secure the sheepskin sleeve to the block and to provide stability to the location of the sleeve with the uninterrupted nap exposed from the bottom wall of said block-like member.

6. The floor treating device of claim 5 wherein said sheepskin sleeve being formed from a plurality of sheepskin blanks and having a plurality of said longitudinal edges with interconnecting elements and with all seams projecting inwardly and aligned with and engaging the block in spaced relation to said bottom wall.

7. The floor treating device of claim 6 with said longitudinal seams facing inwardly of the sleeve and abutting said block member.

8. The floor treating device of claim 6 with said longitudinal seams facing outwardly of the sleeve and said block member.

9. The floor treating device of claim 5 wherein said first and second couplings respectively consist of a threaded opening and a raised coupling rod.

10. The floor treating device of claim 5 wherein said tubular sheepskin sleeve includes a bottom sleeve blank and a top sleeve blank, said sleeve blanks each being formed of a tanned sheepskin and having first and second longitudinal overlapping and aligned edges located in spaced relation with uninterrupted exposed nap having a width in excess of the width of the bottom wall of said block member, said first and second aligned edges each being interconnected to each other to form exposed longitudinal seams in said tubular sheepskin sleeve.

11. The floor treating device of claim 10 wherein said first-named handle coupling is a threaded opening and said second handle coupling is a raised rod.

12. A floor treating device comprising a head in the form of an elongated block member, said head having a bottom wall and a top wall, a handle coupling on the top side of said block member, a tubular tanned sheepskin sleeve having an open end and snugly fitted over said block member and having an opening aligned with said handle coupling, a handle releasably secured to said handle coupling to secure the sleeve to the block member and provide stability to the location of the sleeve with the complete and uninterrupted nap exposed from the bottom wall of said block member, said sheepskin sleeve being formed from a single sheepskin blank having aligned longitudinal edges, means securing said longitudinal edges to each other in spaced relation to the edges and thereby forming a projecting seam engaging said block member.

13. The floor treating device of claim 12 wherein said seam projects inwardly with said edges in abutting engagement with said block member.

14. The floor treating device of claim 12 including a second handle coupling secured to the top wall of said block member in spaced relation to said first-named handle coupling.

15. A floor treating device comprising a rigid wooden block having a top wall and a bottom wall, said bottom wall having a length and a width defining a floor treating area, a tubular sheepskin sleeve having an open end and close fitted over said wooden block and formed by at least one blank of tanned sheepskin and said blank having at least one longitudinal seam extending throughout the length of said block and defining said tubular sleeve and having said seam spaced from said bottom wall, said top wall of said wooden block having a handle coupling unit, said sheepskin sleeve having an opening aligned with said handle coupling unit, a handle releasably secured to said handle coupling unit and forming an interlock with said sleeve to stabilize the sleeve on said wooden block.

16. A sheepskin sleeve for releasable coupling to the head of floor treating device, said head comprising a substantially block element having a top wall and a spaced bottom wall, said top wall having a handle coupler for releasably holding a handle extending therefrom, said sheepskin sleeve being formed with the original skin and outer nap comprising a tubular sheepskin sleeve having an internal diameter substantially corresponding to the external configuration of said block element for snug fitting onto said block element, said tubular sheepskin being formed from at least one sheepskin blank having aligned edges extending therethrough the length of the block element and a means connecting said sheepskin blank inwardly of said edges forming an interconnected longitudinal seam and having an opening for alignment with said coupler and handle for stabilizing the tubular sheepskin to said head and said sheepskin sleeve having an uninterrupted bottom nap surface when assembled on said block element, said opening being substantially of the shape and size of said handle coupler.

* * * * *

UNITED STATES PATENT AND TRADEMARK OFFICE

CERTIFICATE OF CORRECTION

PATENT NO. : 5,852,842

DATED : December 29, 1998

INVENTOR(S) : JEFFREY A. STERN

It is certified that error appears in the above-identified patent and that said Letters Patent is hereby corrected as shown below:

In The Claims

Claim 5, column 6, line 17, delete "said" and substitute therefor -- a --; Claim 5, column 6, line 18, delete "said" and substitute therefor -- a --; Claim 5, column 6, line 34, delete "block-like" and substitute therefor -- block --.

Signed and Sealed this

Fourth Day of January, 2000

*Attest:*

*Attesting Officer*

*Acting Commissioner of Patents and Trademarks*